US005567067A

United States Patent [19]

Ambrose

[11] Patent Number: 5,567,067

[45] Date of Patent: Oct. 22, 1996

[54] KEYBOARD POSITIONING SYSTEM

[76] Inventor: Frederic C. Ambrose, 13 Pilgrim Heights Rd., Provincetown, Mass. 02657

[21] Appl. No.: 511,535

[22] Filed: Aug. 4, 1995

Related U.S. Application Data

[63] Continuation of Ser. No. 303,582, Sep. 9, 1994, abandoned, which is a continuation of Ser. No. 60,720, May 10, 1993, abandoned, which is a continuation of Ser. No. 982,879, Nov. 30, 1992, abandoned, which is a continuation of Ser. No. 910,667, Jul. 8, 1992, abandoned, which is a continuation of Ser. No. 648,628, Feb. 1, 1991, abandoned.

[51] Int. Cl.[6] ..... B41J 5/08

[52] U.S. Cl. ..... 400/472; 400/715; 248/118.1

[58] Field of Search ..... 400/472, 473, 400/480, 481, 489, 488, 681, 715; 248/118, 118.1–118.5, 918; 235/146, 145 A, 145 R; 312/208.1, 208.4

[56] References Cited

U.S. PATENT DOCUMENTS

| | | | |
|---|---|---|---|
| 293,971 | 2/1884 | Lyford | 308/107 |
| 1,189,529 | 7/1916 | Benson | 38/106 |
| 1,277,169 | 8/1918 | Anderson | 248/118.3 |
| 3,830,352 | 8/1974 | Kolpek | 400/681 |
| 3,902,034 | 8/1974 | Isozaki | 200/239 |
| 4,307,672 | 12/1981 | Shikimi | 108/139 |
| 4,481,556 | 11/1984 | Berke et al. | 400/715 |
| 4,515,086 | 5/1985 | Kwiecinski et al. | 108/96 |
| 4,545,544 | 10/1985 | Latino et al. | 248/118.1 |
| 4,616,798 | 10/1986 | Smeenge et al. | 248/281.1 |
| 4,632,349 | 12/1986 | Ansley | 248/281.1 |
| 4,664,875 | 2/1987 | Watt | 108/143 |
| 4,688,862 | 8/1987 | Fowler et al. | 400/715 |
| 4,709,972 | 12/1987 | LaBudde et al. | 312/208 |
| 4,736,689 | 4/1988 | Stanko | 108/5 |
| 4,779,922 | 10/1988 | Cooper | 297/188 |
| 4,826,123 | 5/1989 | Hannah et al. | 248/248 |
| 4,852,500 | 8/1989 | Ryburg et al. | 108/105 |
| 4,913,390 | 4/1990 | Berke | 248/118.5 |
| 4,923,259 | 5/1990 | Bartok | 312/208 |
| 4,976,407 | 12/1990 | Schwartz et al. | 248/118.3 |
| 5,005,669 | 4/1990 | Umebara | 186/61 |
| 5,016,367 | 5/1991 | Breen | 38/135 |
| 5,037,054 | 8/1991 | McConnell | 248/284 |
| 5,040,757 | 8/1991 | Benaway | 248/118.3 |
| 5,048,784 | 9/1991 | Schwartz et al. | 248/244 |
| 5,119,742 | 6/1992 | Simmie | 108/152 |
| 5,154,390 | 10/1992 | Bain et al. | 248/447.2 |
| 5,183,230 | 2/1993 | Walker | 248/118 |
| 5,205,631 | 4/1993 | Wegman et al. | 312/348.2 |
| 5,242,139 | 9/1993 | Aldrich | 248/118.1 |
| 5,320,313 | 6/1994 | Crowe | 248/918 |
| 5,351,897 | 10/1994 | Martin | 248/918 |
| 5,357,873 | 10/1994 | Hilton | 108/50 |
| 5,374,018 | 12/1994 | Daneshvar | 248/118 |

OTHER PUBLICATIONS

Stack, B., "Keyboard RSI: The Practical Solution" Publication Date Unknown. pp. 29–37.

Stack, B., "Repetitive Strain Injury–Prevention and Rehabilitation", First International Congress on Ergonomics, Occupational Health and Safety and the Environment.

Patkin, M., "Neck and Arm Pain in Office Workers: Causes and Management", reproduced in Promoting health productivity in the computerized office: Models of successful ergonomic interventions, Chapter 13, (Taylor & Francis, New York) pp. 207–231, 1990.

(List continued on next page.)

*Primary Examiner*—Edgar S. Burr
*Assistant Examiner*—Anthony H. Nguyen
*Attorney, Agent, or Firm*—Steven N. Fox, Esq.

[57] ABSTRACT

A keyboard positioning system in which the keyboard is positioned with its rear edge substantially lower than its forward, or operator edge in order that the operator might use the keyboard with the plane of the operator's hands parallel to, or below the line of the operator's forearm, thus reducing the incidence of carpal tunnel syndrome. A hand support bar is provided to support the operator's hands while keyboarding.

28 Claims, 4 Drawing Sheets

OTHER PUBLICATIONS

Hedge et al, "An experimental test of a Design Prototype Of The Protex System", pp. 7–12, Dec. 1, 1991.

IBM Technical Disclosure Bulletin, vol. 27 No. 1A, Jun. 1984, "Adjustable Keyboard", E. H. Frank, pp. 153–154.

IBM Technical Disclosure Bulletin, vol. 28 No. 1, Jul. 1985, "Adjustable Terminal Table", Author Unknown, pp. 747–750.

Tiffany Office Furniture Catalog, pp. 3 & 11, 1989.

Tiffany Office Furniture Catalog, pp. 13–16 & 30. 1990

Steelcase Product Review, effective Oct. 27, 1986.

Patkin, M., "*Neck and arm pain in office workers*", In Sauter et al., (eds.) *Promoting health and productivity in the computerized office*, Chap. 13, pp. 207–231. 1990

Hedge et al. '*An Experimental Test of a Design Prototype of the Protex* ™ System 1991.

Stack, B., Repetitive strain injury–prevention and rehabilitation. Proceedings, First International Congress on Ergonomics, Occupational Safety and Health and the Environment, publication date unknown.

Stack, B., New Design concepts in wrist rests, desks and keyboard supports. Preprints of International Conference on Ergonomics, Occupational Safety and Health and the Environment, 1, 444–453, date of publication unknown.

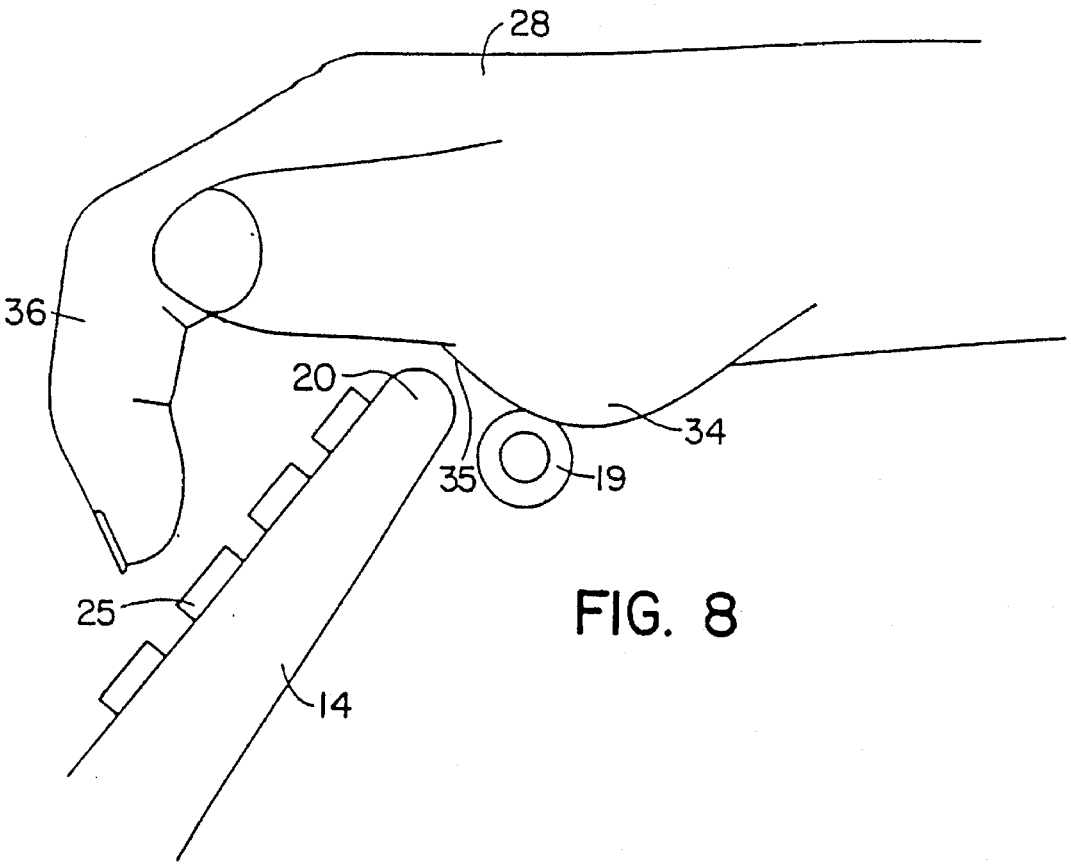
FIG. 8
FIG. 9
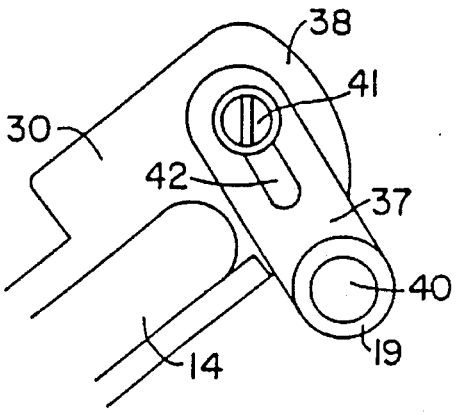
FIG. 10
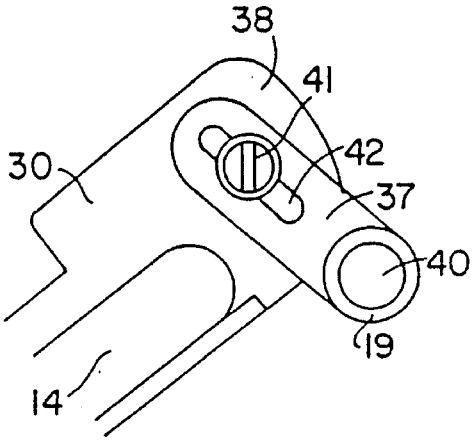

KEYBOARD POSITIONING SYSTEM

This is a continuation of application Ser. No. 08/303,582 filed on Sep. 9, 1994 now abandoned, which is a continuation of application Ser. No. 08/060,720 filed on May 10, 1993 now abandoned, which is a continuation of application Ser. No. 07/982,879 filed on Nov. 30, 1992 now abandoned, which is a continuation of application Ser No. 07/910,667 filed on Jul. 8, 1992 now abandoned, which is a continuation of application Ser. No. 07/648,628 filed on Feb. 1, 1991 now abandoned.

BACKGROUND OF THE INVENTION

In the design of alphanumeric keyboards for use in typewriters, computers, typesetters, and certain scientific and technical instruments, it has been generally assumed that the keyboard must be tilted forward, that is, the front or operator edge of the keyboard surface must be lower than the rear edge of the keyboard surface. It will be recognized that the word keyboard in this patent application will generally be used to apply to the above types of keyboards as opposed to the keyboards found in musical instruments. The assumption that this orientation is the proper way to design a keyboard may have many origins. Certainly, from the point of view of mechanical orientation of the mechanical links found in early keyboard systems this arrangement was probably necessary. Furthermore, for operators who are not "touch" typists, it was generally necessary and desirable that the keys be arranged in such a way that their identity, designated by symbols on the keys, could be easily visible to the operator by tipping the surface of the keyboard toward the operator. Furthermore, a somewhat mechanistic concept of how the human hand operates might well suggest that the forward tipping of the keyboard would be the most efficient way of positioning the keyboard before the operator. For these and other reasons, the forward tipping of the keyboard plane is essentially universal. Such a typical orientation is shown in FIG. 1 of the drawings.

In a separate development, the medical community has become increasingly aware of an extremely irritating, but non-lethal physical affliction, known generally as the "carpal tunnel" syndrome. In this affliction, the median nerve, which extends down the arm and out to the human hand, can be damaged at the point at which it passes through the human wrist joint. The occurrence of this affliction has a large number of unpleasant physical consequences. Generally, the affliction is associated with situations in which the hand and wrist are bent upward and backward and, while in that position, significant weight is applied to the wrist. This phenomenon which is very common among serious bicycle riders can result in long term pain and disability.

It has been observed that the carpal tunnel syndrome is frequently associated with persons who are professional keyboard operators. It appears that the forward tilt of the keyboard, which is universally accepted as the proper design for a keyboard, may well force the operator, on a long term, continuous basis, to arch back the hand and wrist in such a way that, over the many years that the operator may be sitting before the keyboard, permanent work place injury could result. This unfortunate circumstance may well be resulting in serious long term human suffering and, of course, the financial liabilities and difficulties which can be associated with such human suffering. This problem is compounded by another aspect of conventional keyboard design. Ordinarily, the operator is required to sit before the keyboard with hands extended over the keyboard. Holding the hands over the keyboard for hours at a time places tremendous stress on the operator's shoulder and neck muscles. In conventional mechanical typewriters, this uncomfortable and potentially harmful condition was constantly relieved by the peripheral activities required by the mechanical typewriter; i.e., hitting the carriage return bar and changing sheets of paper. With modern word processing systems, the operator can literally spend hours without removing his or her hand, from the keyboard. The long term effect of holding one's hands over the keyboard, day after day, year after year, may well cause harmful neck and shoulder muscle stress. These and other difficulties experienced with the prior art devices, have been obviated in a novel manner by the present invention. It is therefore, an outstanding object of the invention to provide a keyboard positioning system in which the keyboard is tipped backward so that the operator's hands and wrist assume a position which does not cause irritation or damage to nerves which pass through the wrist joint.

Another object of the invention is the provision of a keyboard positioning system which holds the keyboard in a position in which it is tipped backwards in order to provide a more comfortable and restful orientation for professional or long term keyboard operators.

A further objective of the present invention is to provide a keyboard system which supports the operator's hands in a proper position over the keyboard in order to minimize neck and shoulder muscle strain.

With these and other objects in view, as will be apparent to those skilled in the art, the invention resides in the combination of parts set forth in the specification and covered by the claims appended hereto.

SUMMARY OF THE INVENTION

This invention is a keyboard positioning system which allows the keyboard to be positioned so that it is tipped backward. By "tipped backward" is meant that the rear edge, or plane, which is away from the operator, is below the forward edge, or edge closest to the operator. By orienting the keyboard in this way, the position of the operator's hand can be moved at least to the point where the plane of the hand is parallel to the line of the lower arm, thereby eliminating the stress which leads to the carpal tunnel syndrome. It has been found that, in fact, it is sometimes preferred to allow the plane of the wrist to be positioned slightly downward of the line of the lower arm. In fact, the operators have found this to be a very comfortable position in which to function. Obviously, this position is probably not acceptable to amateur keyboard operators since the visibility of the keyboard, a matter which would be important to amateurs, would be somewhat inhibited.

Furthermore, the keyboard positioning system would be provided with a support bar which supports the operator's hands over the keyboard. In the preferred orientation, the bar would be positioned in front of and below the front edge of the keyboard and would engage the large fleshy portion which lies at the base of the palm of the operator's hands, hereinafter proximal palm portion. The ideal is a "neutral " position.

A keyboard positioning system for holding a keyboard in a position with respect to a base and relative to a human operator. The keyboard positioning system comprises a bracket adapted to be clamped to the keyboard and a positioning bracket adapted to connect the clamping bracket to the base and adapted to be oriented with respect to the clamping bracket in such a way that when the positioning bracket is in place, the clamping bracket can be positioned so that the keyboard is positioned with its rear edge lower than its forward edge. The keyboard positioning system further comprises a hand support bar provided at the operator end of the system in order to support the operator's hands so that the fingers are supported above the plane of the keyboard. The clamping bracket of the keyboard positioning system includes a pair of clamps which shape-conform to the side edges of the keyboard and are adapted to be clamped to the keyboard edges. The positioning bracket of the keyboard positioning system includes a pair of bracket elements.

BRIEF DESCRIPTION OF THE DRAWINGS

The character of the invention, however, may be best understood by reference to one of its structural forms as illustrated by the accompanying drawings, in which:

FIG. 8 is a diagrammatic view of the preferred orientation of the system and operator's hand.

FIG. 9 is a detailed view of a preferred orientation of the palm support.

FIG. 10 is a detailed view of another orientation of the palm support.

DESCRIPTION OF THE PREFERRED EMBODIMENT

Figure 1:
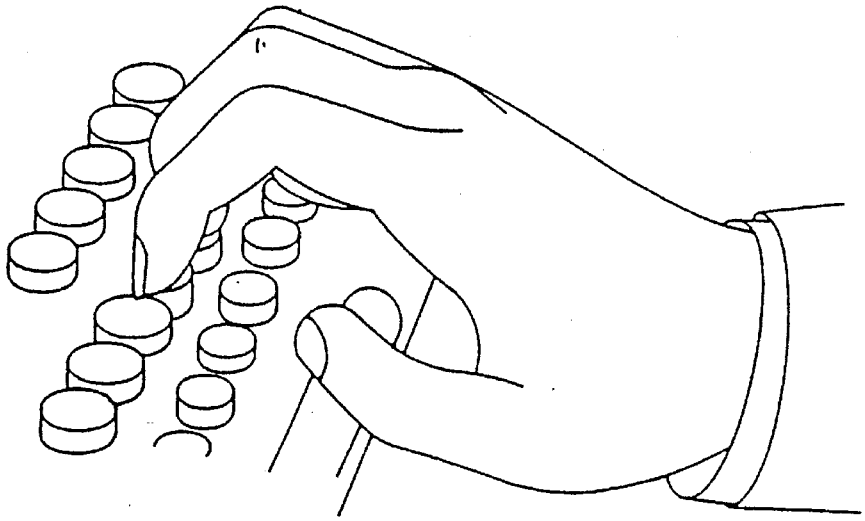
FIG. 1 is a perspective view of the prior art keyboard orientation.
Figure 2:
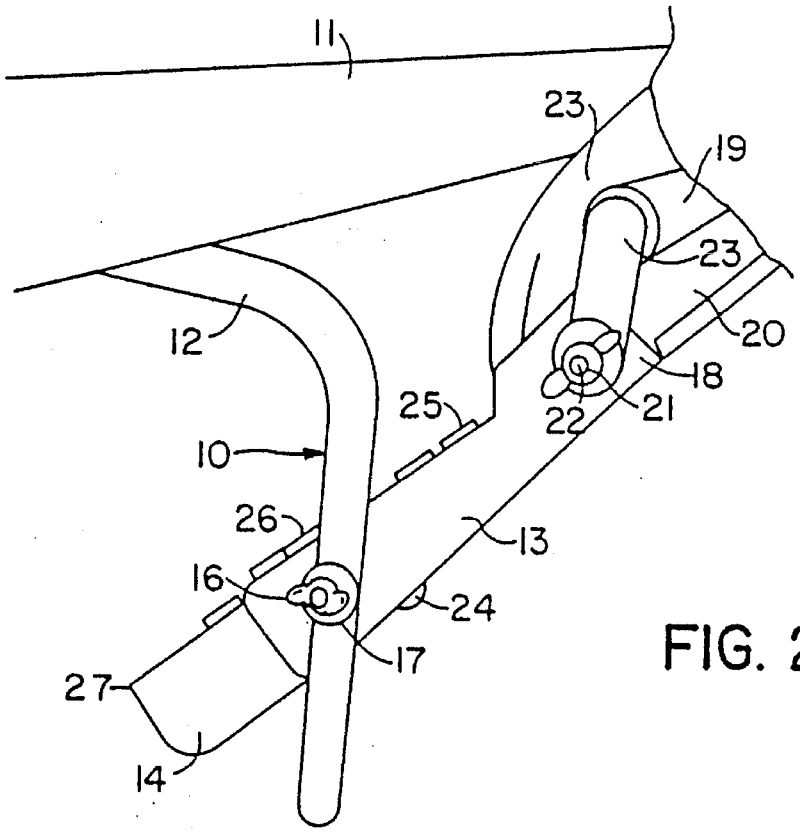
FIG. 2 is a perspective view of an embodiment of the present invention.

Referring first to FIG. 2, where are best shown the general features of the present invention, it can be seen that the keyboard positioning system, generally denominated by the numeral 10, includes a base or desk surface 11, positioning brackets 12 and 29 (not shown) connected to the base 11, clamping or support elements 13 and 30 (not shown), which is adjustably connected to the positioning brackets 12 and 29, respectively, and a keyboard 14 of the conventional computer keyboard type. Support elements 13 and 30 each comprise a forward or front edge 50 and a rear edge 52.

The clamping element 13 is shown adjustably locked to the positioning bracket 12 by a wing nut and bolt combination 16 and 17. At the forward or operating edge 50 of the clamping element 13 is a hand support 19 which extends across the front edge 20 of the keyboard and hand support holder 23 which is attached to the clamping element by means of a wing nut 21 and bolt 22. The clamping element 13 has a holding element 24 (set-screw) which holds the keyboard in the clamping element 13.

The hands 23 of the operator extend over the wrist support bar and hang downwardly toward the keys 25 of the keyboard 14.

The surface 26 of the keyboard is positioned at an angle of approximately 45° from the horizontal with the rear edge 27 lowered. More specifically, if the keyboard plan is deflated as the plane which approximates the upper surfaces of all of the keys, then the preferred embodiment puts the keyboard plane from 30° to 60° down from the horizontal. The invention appears to be beneficial from 10° to 70° and offers some benefit from 0° to 70°.

Figure 3:
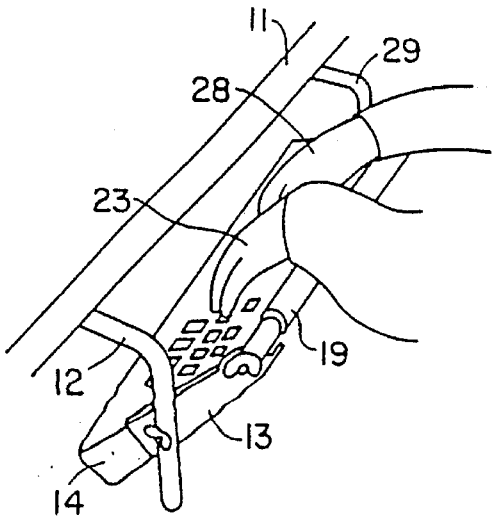
FIG. 3 is another perspective view of an embodiment of the present invention.

Referring now to FIG. 3, it can be seen that both of the hands 23 and 28 of the operator carry over the hand support bar and downward toward the keys 25.

Figure 4:
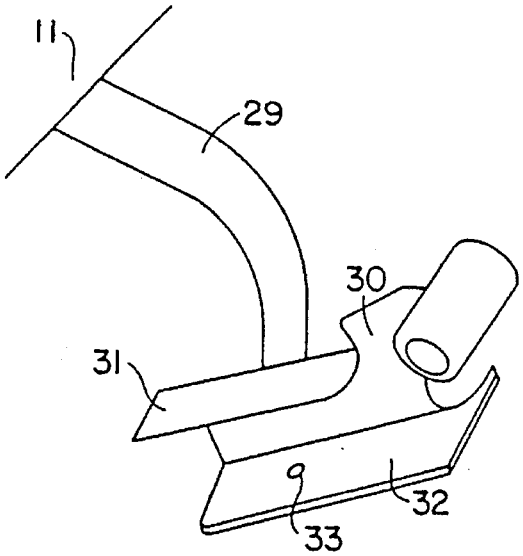
FIG. 4 is a perspective view of the holding clamp and positioning clamp which would be employed at the far end of the embodiments shown in FIGS. 2 and 3, but without the keyboard in the way.

Referring to FIG. 4, it can be seen that the inside surface of the clamp 30 is provided with an [upper clamping flange 31 and lower clamping flange 32 ] which oppose one another and engage the side edge of the keyboard. A set screw 33 allows the clamping elements to securingly engage the keyboard so that it does not slide out.

Figure 5:
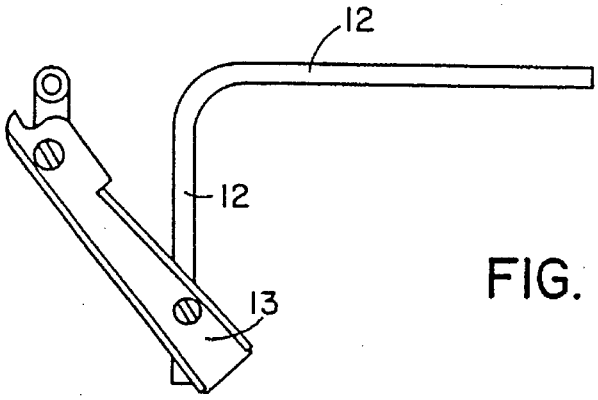
FIG. 5 is a perspective view of the inside view of the system which has the brackets in the embodiments shown in FIGS. 1 and 2.

FIG. 5 shows a view of the inside surface of the clamping system and because it is a side elevational view, the angularity of the clamp with respect to the vertical and horizontal portions of the positioning element can be more clearly seen.

Figure 6:
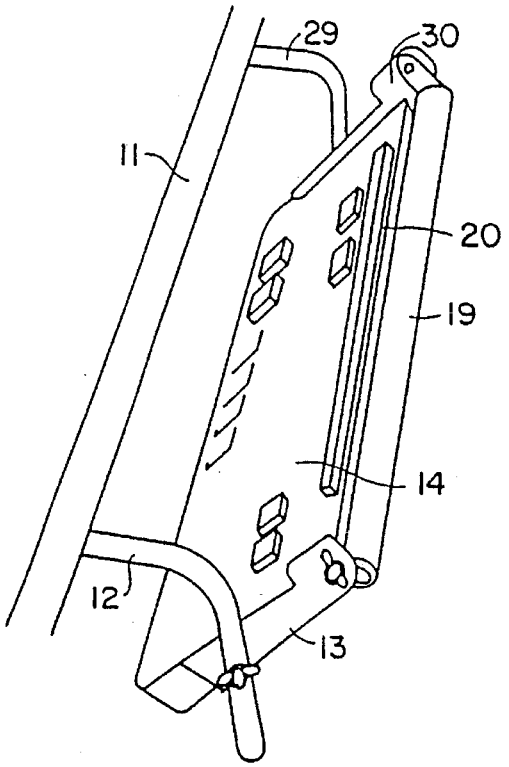
FIG. 6 is a perspective view of a preferred orientation of the system.
Figure 7:
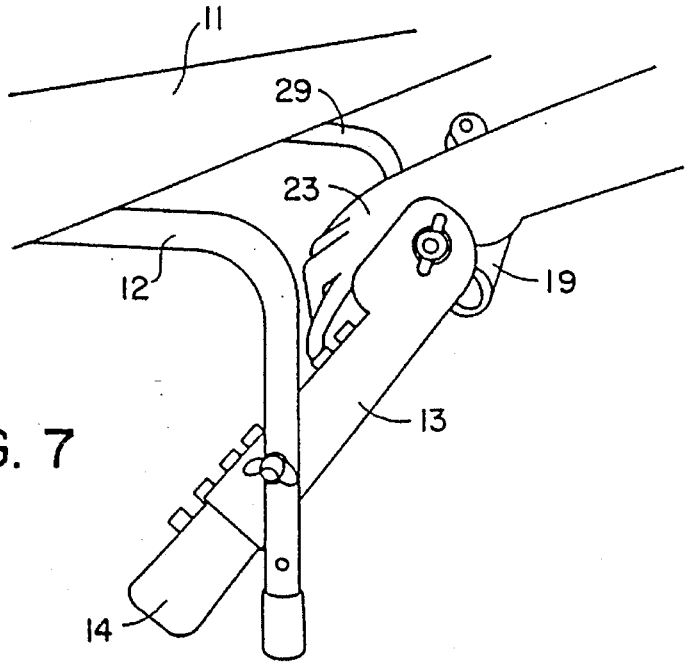
FIG. 7 is a perspective view of the orientation shown in FIG. 6.

FIG. 6 shows a perspective view of the system with the wrist support in the preferred orientation, i.e., below the front edge 20 of the keyboard 14. FIG. 7 is a closer view of the orientation in FIG. 6. showing the operator's hand 23.

FIG. 8 is a diagrammatic view of the preferred orientation of the operator's hand 28, the front edge 20 of the keyboard 14 and the hand support 19. The hand support 19 engages and supports the proximal palm 34. The palm 35 curves over (without touching) the front edge 20 of the keyboard 14 and the fingers 36 reach to the keys 25.

FIGS. 9 and 10 show the orientations of the hand support 19, the hand support holder 37, and the forwarded edge 50 of the clamping element 30. The hand support holder 37 (of which there is one at each end of the hand support) is formed of a plate 39 and a pin 40 mounted on the plate and extending outward from the plane of the drawing. The plate 39 is adjustably mounted to the clamping element 30 by the bolt 41 which extends through the slot 42 in the plate to allow both rotation and radial positioning of the pin 40. The pin 40 is shaped to engage the end of the hand support 19. The hand support 19 is formed of a hollow cylinder which can be easily cut to length and engaged by the pin 40, on one end, and a corresponding pin on the other end. In this way, the system can be adapted to the various widths of the keyboards. For the purposes of this application and invention, the term "neutral position" of the wrist is understood by those of ordinary skill to be that position in which the wrist is neither flexed nor extended. Those of ordinary skill also recognize that keyboard keys are used with differing frequency in written language and that those of greatest frequency of use (i.e., the letter keys) are clustered together around the center of the keyboard in accordance with relative finger strength and dexterity. These are the "most used" keys. An operator's forearms usually define a plane which, if it is not parallel with, has an intersection with that defined by the top surfaces of the keys, thereby clarifying the "key plane" and "the intersection of the key plane and the operator's arm".

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described what is claimed as new and desired to be secured by letters patent is:

1. A device for mounting a keyboard to a base, the keyboard having a front surface and a top surface, the device comprises:

(a) a bracket mounted on the base;

(b) a clamp comprising a front portion, a rear portion, and a support surface, said support surface being engagable with the keyboard, said rear portion being in closer proximity to the base than said front portion when said bracket is mounted on the base, said clamp being connected to said bracket and disposed such that said rear portion is disposed below said front portion; and (c) a hand support member being movably mounted on said clamp from a position at least substantially adjacent the front surface of the keyboard to a position above the top surface of the keyboard while said rear portion of said clamp is below said front portion of said clamp.

2. The device of claim 1, wherein said bracket is secured to the base.

3. The device of claim 1, wherein said clamp is movably connected to said bracket.

4. The device of claim 3, wherein said clamp is rotatably connected to said bracket.

5. The device of claim 1, wherein said hand support member is movably connected to said clamp.

6. The device of claim 5, wherein said hand support member is rotatably connected to said clamp.

7. The device of claim 1, wherein said clamp comprises first and second clamp elements each comprising a front portion, a rear portion, and a support surface, each of said support surfaces being engagable with the keyboard.

8. The device of claim 7, wherein said hand support member is movably connected to said first and second clamp elements.

9. The device of claim 8, wherein said hand support member is rotatably connected to said first and second clamp elements.

10. The device of claim 7, wherein said bracket comprises first and second bracket elements.

11. The device of claim 10, wherein each of said first and second bracket elements comprise an elongated arm.

12. The device of claim 11, wherein said first clamp element is connected to said first bracket element and said second clamp element is connected to said second bracket element.

13. The device of claim 12, wherein said first clamp element is movably connected to said first bracket element and said second clamp element is movably connected to said second bracket element.

14. The device of claim 13, wherein said first clamp element is rotatably connected to said first bracket element and said second clamp element is rotatably connected to said second bracket element.

15. The device of claim 14, wherein said hand support member is movably connected to said first and second clamp elements.

16. The device of claim 15, wherein said first and second bracket elements are each secured to the base.

17. The device of claim 15, wherein said hand support member is rotatably connected to said first and second clamp elements.

18. The device of claim 7, wherein each of said first and second clamp elements are in the shape of a channel.

19. A device for mounting a keyboard to a base, the keyboard having a front surface and a top surface, the device comprises:

(a) a first bracket member mounted on the base;

(b) a second bracket member mounted on the base;

(c) a first clamp member comprising a front portion, a rear portion, and a support surface, said support surface being engagable with the keyboard, said rear portion being in closer proximity to the base than said front portion when said first bracket member is mounted on the base, said first clamp member being connected to said first bracket member and disposed such that said rear portion is disposed below said front portion;

(d) a second clamp member comprising a front portion, a rear portion, and a support surface, said support surface being engagable with the keyboard, said rear portion being in closer proximity to the base than said front portion when said first bracket member is mounted on the base, said second clamp member being connected to said second bracket member and disposed such that said rear portion is disposed below said front portion; and (e) a hand support member being movably mounted on said first and second clamp members from a position at least substantially adjacent the front surface of the keyboard to a position above the top surface of the keyboard while said rear portions of said first and second clamp members are below said front portions of said first and second clamp members.

20. The device of claim 19, wherein said first bracket member comprises an elongated arm.

21. The device of claim 19, wherein said first clamp member is in the shape of a channel.

22. The device of claim 19, wherein said first bracket member is secured to the base.

23. The device of claim 19, wherein said first clamp member is movably connected to said first bracket member.

24. The device of claim 23, wherein said first clamp member is rotatably connected to said first bracket member.

25. The device of claim 19, wherein said second clamp member is movably connected to said second bracket member.

26. The device of claim 25, wherein said second clamp member is rotatably connected to said second bracket member.

27. The device of claim 19, wherein said hand support member is movably connected to said first and second bracket members.

28. The device of claim 27, wherein said hand support member is rotatably connected to said first and second bracket members.

* * * * *